US010229576B2

(12) United States Patent
Yang

(10) Patent No.: US 10,229,576 B2
(45) Date of Patent: Mar. 12, 2019

(54) USER EQUIPMENT, EARTHQUAKE ALERT SERVER AND EARTHQUAKE ALERT METHOD THEREOF

(71) Applicant: Wei-Chih Yang, Taipei (TW)

(72) Inventor: Wei-Chih Yang, Taipei (TW)

( * ) Notice: Subject to any disclaimer, the term of this patent is extended or adjusted under 35 U.S.C. 154(b) by 0 days.

(21) Appl. No.: 15/950,135

(22) Filed: Apr. 10, 2018

(65) Prior Publication Data

US 2018/0293867 A1 Oct. 11, 2018

(30) Foreign Application Priority Data

Apr. 11, 2017 (TW) ..... 106112021 A

(51) Int. Cl.
*G08B 21/00* (2006.01)
*G08B 21/10* (2006.01)
*G08B 25/10* (2006.01)

(52) U.S. Cl.
CPC ..... *G08B 21/10* (2013.01); *G08B 25/10* (2013.01)

(58) Field of Classification Search
CPC ..... G08B 21/10; G08B 25/10
USPC ..... 340/690
See application file for complete search history.

(56) References Cited

U.S. PATENT DOCUMENTS 5,420,380 A * 5/1995 Harben ..... G01V 1/008 181/122
5,742,235 A * 4/1998 Miche ..... G01V 1/008 200/61.49
9,591,437 B2 * 3/2017 Bahl ..... H04W 4/02
2002/0152053 A1 * 10/2002 Roy ..... G01V 1/003 702/185
2006/0015254 A1 * 1/2006 Smith ..... H04W 4/02 702/3
2008/0137484 A1 * 6/2008 Scott ..... G01V 1/184 367/188
2011/0037588 A1 * 2/2011 Zeng ..... G01V 1/008 340/539.1
2014/0188394 A1 * 7/2014 Febonio ..... G06F 17/5004 702/15
2015/0084788 A1 * 3/2015 Wu ..... G01V 1/008 340/870.16
2015/0195693 A1 * 7/2015 Hooriani ..... H04W 4/90 455/404.2

(Continued)

*Primary Examiner* — Naomi J Small
(74) *Attorney, Agent, or Firm* — Skaar Ulbrich Macari, P.A.

(57) ABSTRACT

A user equipment, an earthquake alert server and an earthquake alert method thereof are provided. The earthquake alert server divides a map into a plurality of geographic grids and receives earthquake reporting messages from a plurality of user equipments. The earthquake alert server monitors the number of reporting messages of each geographic grid within a time interval to determine candidate earthquake grids, and determines earthquake grids according to the adjacent relationship among the candidate earthquake grids. The earthquake alert server chooses any two of the earthquake grids to classify the earthquake grids into two groups and increases a far value of each earthquake grid in the group whose reporting time is later. After multiple choices, the earthquake alert server labels the earthquake grid having the smallest far value as the epicenter grid and transmits an earthquake alert message to a plurality of remote equipments accordingly.

12 Claims, 11 Drawing Sheets

(56) References Cited

U.S. PATENT DOCUMENTS

| | | | | |
|---|---|---|---|---|
| 2016/0011325 | A1* | 1/2016 | Taya | G01V 1/303<br>702/15 |
| 2017/0127257 | A1* | 5/2017 | Saxena | H04W 4/023 |

* cited by examiner

USER EQUIPMENT, EARTHQUAKE ALERT SERVER AND EARTHQUAKE ALERT METHOD THEREOF

PRIORITY

This application claims priority to Taiwan Patent Application No. 106112021 filed on Apr. 11, 2017, which is hereby incorporated by reference in its entirety.

FIELD

The present invention relates to a user equipment, an earthquake alert server and an earthquake alert method thereof. More particularly, the earthquake alert server of the present invention divides a map into a plurality of geographic grids, receives an earthquake reporting message from each of a plurality of user equipments to determine an epicenter from the geographic grids, and transmits an earthquake alert message to the user equipment that is being served.

BACKGROUND

Earthquake is one of the most serious natural disasters on the earth. Every time a strong earthquake occurs, inestimably huge losses and casualties will be caused to humans and the nature. Although it is almost impossible to predict an earthquake, the longest escape time can be obtained if an earthquake alert can be issued in the shortest time after the occurrence of the earthquake.

As technology advances, people have reached a high level in recording and detecting earthquakes in recent years, and construction techniques relevant to earthquake alert systems are also increasingly mature, e.g., Earthquake Early Warning (EEW). Most countries in seismic zones nowadays have a sufficiently large scale of earthquake alert systems in order to reduce the loss to the greatest extent at the arrival of the natural disasters. The general earthquake alert systems utilize more than three earthquake detecting stations to detect the arrival time of earthquake waves when the earthquake occurs, and accordingly infer the time of the earthquake occurrences and an epicenter position.

However, the erection of the earthquake detecting stations is highly demanding on environmental conditions, and the earthquake detecting stations are hardly fault tolerant for interferences, for example, caused by the passing by of trains, trucks or wild animals. As a result, the earthquake detecting stations can only be erected in locations with less environmental interferences. In this case, it is almost impossible to erect the earthquake detecting stations near the center of a densely populated city, hence making it almost impossible to issue an alert immediately at the occurrence of an earthquake of which the epicenter is near the center of the city, because it would already be too late when the earthquake is detected by the earthquake detecting stations that are far away from the epicenter.

Moreover, a certain degree of density of earthquake detecting stations is required in order to improve the epicenter positioning accuracy of the earthquake alert system. However, the cost of erecting an earthquake detecting station is very high, so a considerably high construction cost is inevitable when increasing the density of the earthquake detecting stations to improve the epicenter positioning accuracy.

Accordingly, there is an urgent need in the art to provide an earthquake detecting mechanism that is able to shorten the time for earthquake detections and to provide an instant alert with minimum construction cost.

SUMMARY

An objective of the present invention is to provide an earthquake detecting mechanism that is able to detect an earthquake and to issue an earthquake alert without using the existing earthquake detecting stations. The earthquake detecting mechanism of the present invention establishes an earthquake alarm system via smart phones of people (user equipments) and a remote earthquake alert server. A motion sensor (e.g., a gravity sensor) and a positioning module (e.g., a global positioning system (GPS) module) built in the smart phone may sense the earthquake and provide a geographic position of the earthquake. Meanwhile, by connecting to the earthquake alert server, the smart phone may instantly transmit an earthquake reporting message to the earthquake alert server.

After receiving earthquake reporting messages from a plurality of smart phones at different geographic positions, the earthquake alert server may select the earthquake reporting messages of a higher reliability through filtering the received earthquake reporting messages, in order to analyze the direction of the earthquake and determine the position of an epicenter. Accordingly, as compared to detecting the earthquake via the earthquake detecting stations in the prior art, a high density of earthquake reporting messages are provided via smart phones of people in the present invention to achieve epicenter positioning at a low cost and a high accuracy, and meanwhile a timely earthquake detection and alert service can be provided through telecommunication transmission at a higher speed (as compared to the propagation speed of the earthquake wave) to obtain more escape time.

The disclosure includes an earthquake alert server which comprises a network interface, a storage and a processor. The network interface connects to a network. The storage is configured to store a map. The processor is electrically connected to the storage and the network interface and is configured to execute the following operations: dividing the map into a plurality of geographic grids; receiving an earthquake reporting message from each of a plurality of user equipments via the network interface, each of the earthquake reporting messages comprising a longitude and latitude value, a time stamp and an earthquake intensity; mapping each of the earthquake reporting messages to one of the geographic grids according to the longitude and latitude value of the earthquake reporting message; determining, for each of the geographic grids, a number of earthquake reporting messages of the geographic grid within a time interval according to the time stamp of each of the earthquake reporting messages corresponding to the geographic grid; labeling the geographic grid, of which the number of earthquake reporting messages within the time interval is greater than a threshold, as a candidate earthquake geographic grid; labeling each of the candidate earthquake geographic grids, which are adjacent, as an earthquake geographic grid; determining, for each of the earthquake geographic grids, an earthquake reporting time of the earthquake geographic grid according to the time stamp of each of the earthquake reporting messages corresponding to the earthquake geographic grid; choosing any two of the earthquake geographic grids to obtain a plurality of combinations that are non-repetitive; dividing, for each of the combinations, the earthquake geographic grids into two groups according to a middle point of the two earthquake geographic grids of the combination in the map, and increasing a far value of the earthquake geographic grids in the group, including one of the two earthquake geographic grids of which the earthquake reporting time is later, by one unit; labeling the earthquake geographic grid with the smallest far value as an epicenter geographic grid; determining an epicenter position, an epicenter occurrence time and an epicenter intensity according to the longitude and latitude value, the time stamp and the epicenter intensity of each of the earthquake reporting messages corresponding to the epicenter geographic grid; generating an earthquake alert message carrying the epicenter position, the epicenter occurrence time and the epicenter intensity; and transmitting the earthquake alert message to a plurality of remote devices via the network interface, wherein the remote devices include the user equipments.

The disclosure also includes an earthquake alert method for an earthquake alert server. The earthquake alert server comprises a network interface, a storage and a processor. The network interface connects to a network. The storage stores a map therein. The earthquake alert method is executed by the processor and comprises the following steps of: (a) dividing the map into a plurality of geographic grids; (b) receiving an earthquake reporting message from each of a plurality of user equipments via the network interface, each of the earthquake reporting messages comprising a longitude and latitude value, a time stamp and an earthquake intensity; (c) mapping each of the earthquake reporting messages to one of the geographic grids according to the longitude and latitude value of the earthquake reporting message; (d) determining, for each of the geographic grids, a number of earthquake reporting messages of the geographic grid within a time interval according to the time stamp of each of the earthquake reporting messages corresponding to the geographic grid; (e) labeling the geographic grid, of which the number of earthquake reporting messages within the time interval is greater than a threshold, as a candidate earthquake geographic grid; (f) labeling each of the candidate earthquake geographic grids, which are adjacent, as an earthquake geographic grid; (g) determining, for each of the earthquake geographic grids, an earthquake reporting time of the earthquake geographic grid according to the time stamp of each of the earthquake reporting messages corresponding to the earthquake geographic grid; (h) choosing any two of the earthquake geographic grids to obtain a plurality of combinations that are non-repetitive; (i) dividing, for each of the combinations, the earthquake geographic grids into two groups according to a middle point of the two earthquake geographic grids of the combination in the map, and increasing a far value of the earthquake geographic grids in the group, including one of the two earthquake geographic grids of which the earthquake reporting time is later, by one unit; (j) labeling the earthquake geographic grid with the smallest far value as an epicenter geographic grid; (k) determining an epicenter position, an epicenter occurrence time and an epicenter intensity according to the longitude and latitude value, the time stamp and the epicenter intensity of each of the earthquake reporting messages corresponding to the epicenter geographic grid; (l) generating an earthquake alert message carrying the epicenter position, the epicenter occurrence time and the epicenter intensity; and (m) transmitting the earthquake alert message to a plurality of remote devices via the network interface, wherein the remote devices include the user equipments.

The disclosure further includes a user equipment. The user equipment comprises a power source module, a transceiver, a motion sensor, a positioning module and a processor. The motion sensor is configured to sense a motion and generate a sensing signal. The processor is electrically connected to the power source module, the transceiver, the motion sensor and the positioning module, and is configured to execute the following operations: determining that the user equipment is in a charging state in response to connection of the power source module to an external power source; determining that the user equipment is in a connected state in response to connection of the transceiver to a network; determining that the user equipment is in a stationary state in response to the sensing signal received from the motion sensor being smaller than a first threshold continuously within a preset time interval; activating an earthquake detection mode if the user equipment is being in the charging state, the connected state and the stationary state simultaneously to determine whether the sensing signal subsequently received from the motion sensor exceeds a second threshold; if the sensing signal subsequently received from the motion sensor exceeds the second threshold, then calculating an earthquake intensity, recording a time stamp and generating a longitude and latitude value via the positioning module according to the sensing signal; generating an earthquake reporting message comprising the longitude and latitude value, the time stamp and the earthquake intensity; and transmitting the earthquake reporting message to an earthquake alert server via the transceiver.

The detailed technology and preferred embodiments implemented for the subject invention are described in the following paragraphs accompanying the appended drawings for people skilled in this field to well appreciate the features of the claimed invention.

and

Figure 5A:
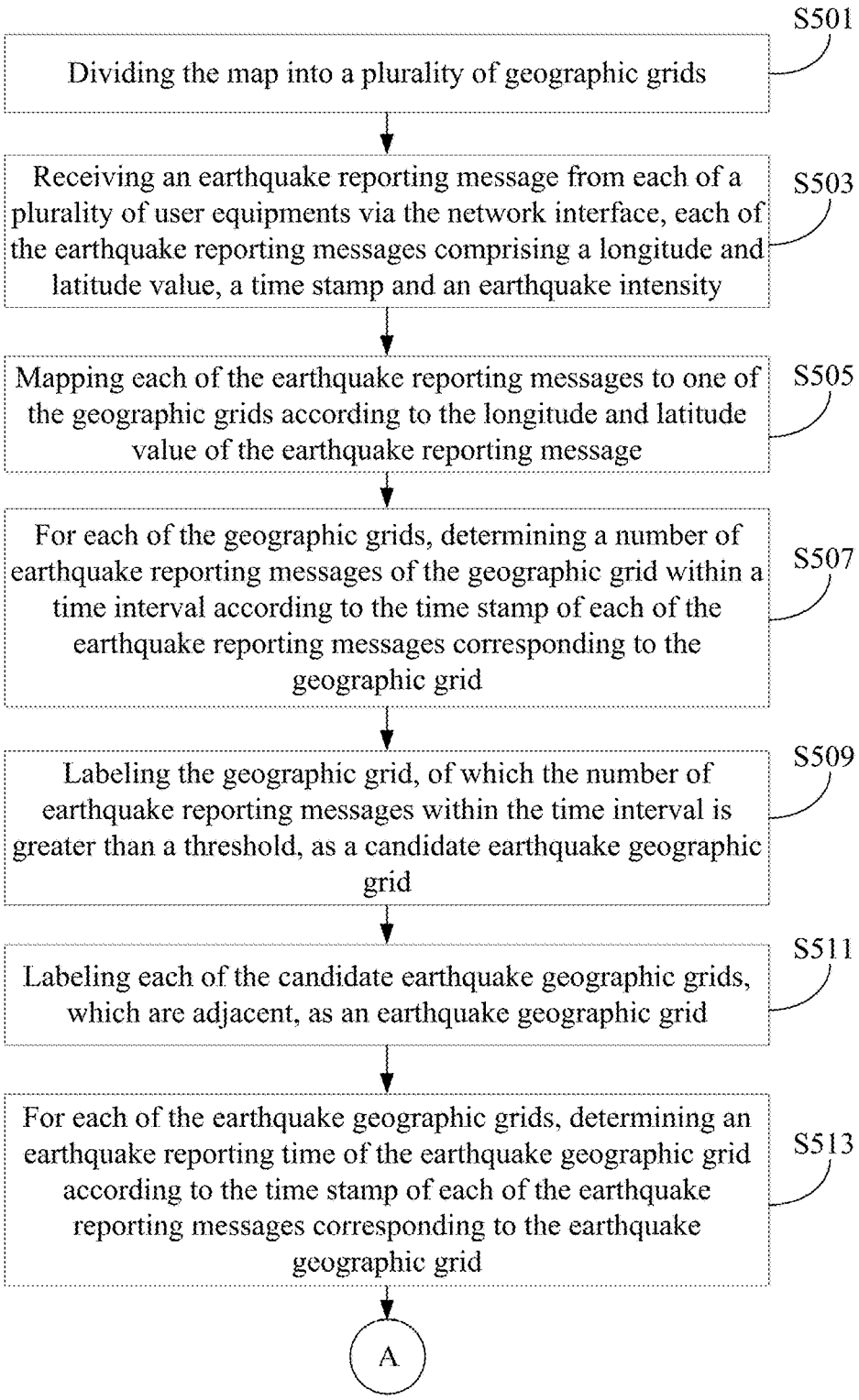
Figure 5B:
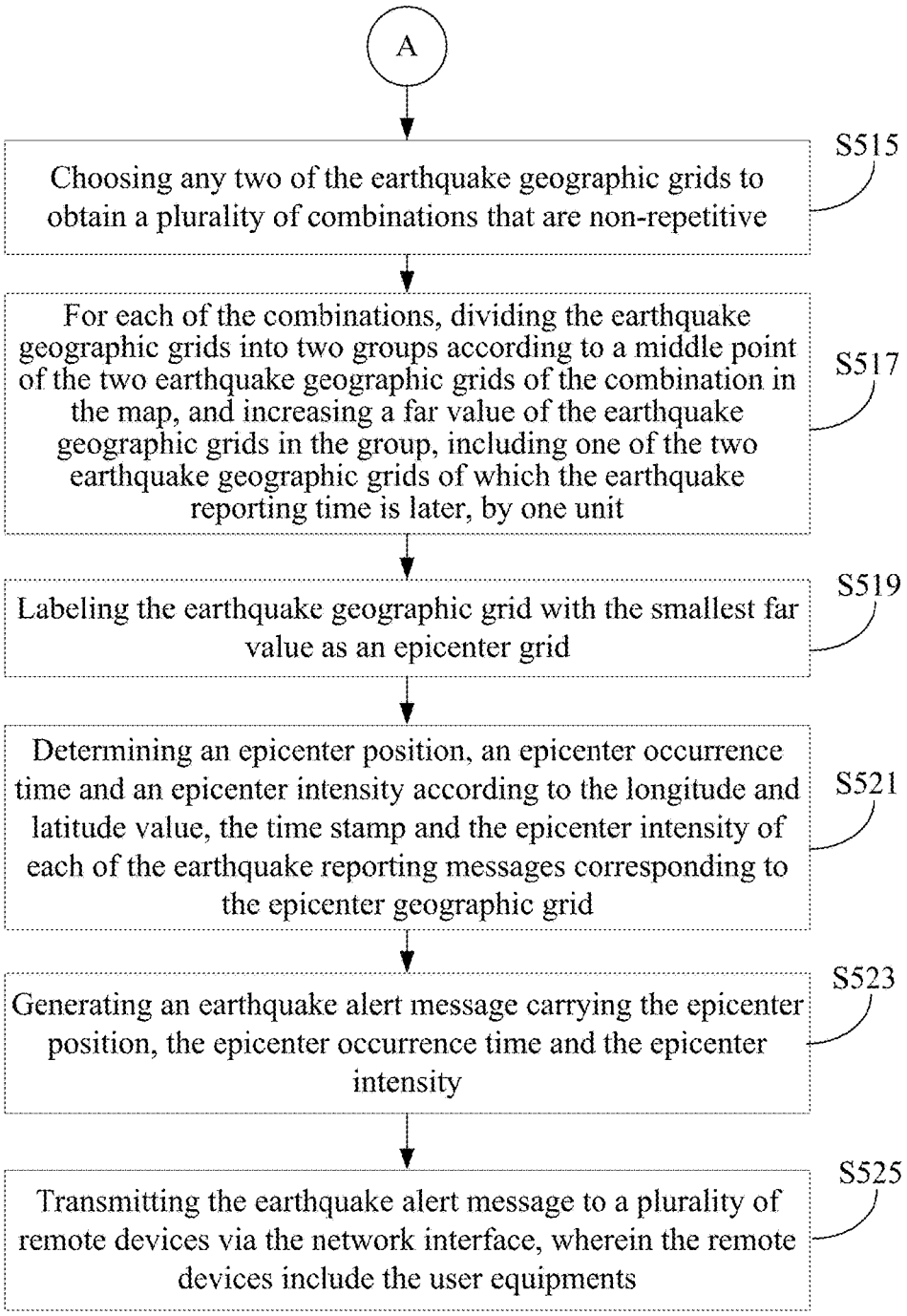

FIG. 5A to FIG. 5B are flowchart diagrams of an earthquake alert method according to the present invention.

DETAILED DESCRIPTION

In the following description, the present invention will be explained with reference to example embodiments thereof. It shall be appreciated that these example embodiments are not intended to limit the present invention to any particular example, embodiment, environment, applications or implementations described in these example embodiments. Therefore, description of these example embodiments is only for purpose of illustration rather than to limit the present invention, and the scope claimed in this application shall be governed by the claims. Besides, in the following embodiments and the attached drawings, elements unrelated to the present invention are omitted from depiction; and dimensional relationships among individual elements in the attached drawings are illustrated only for ease of understanding, but not to limit the actual scale.

Figure 1:
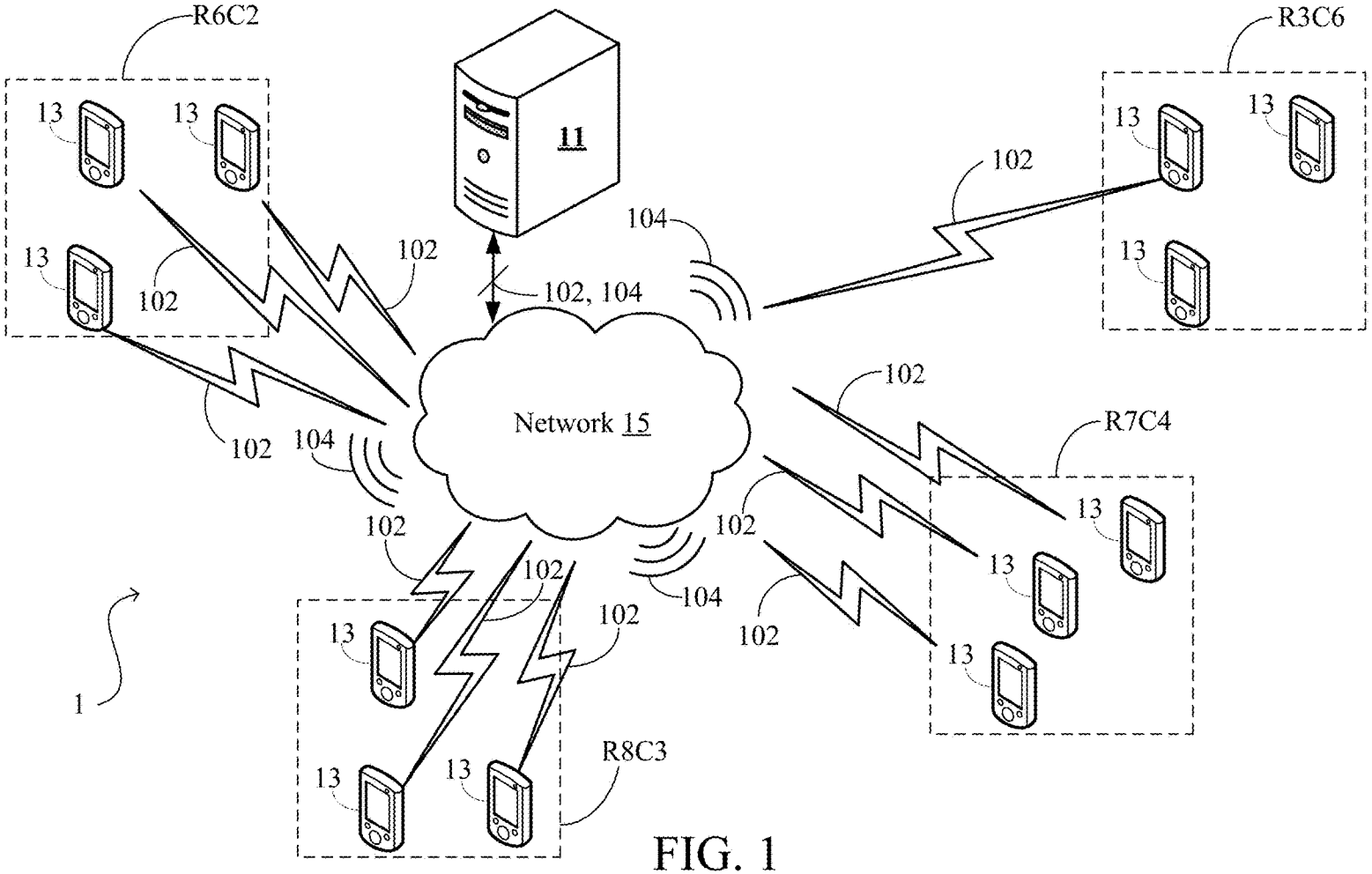
FIG. 1 is a schematic view of an earthquake alert system 1 according to the present invention.
Figure 4:
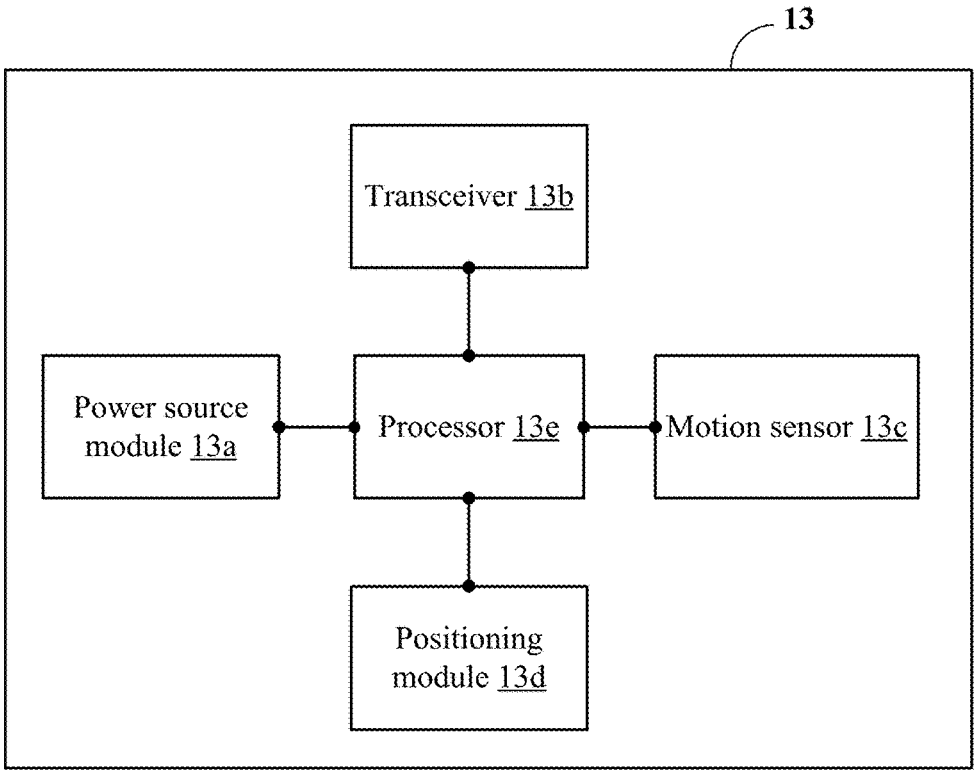
FIG. 4 is a schematic view of a user equipment 13 according to the present invention.

Please refer to FIG. 1 and FIG. 2A to FIG. 2F for a first embodiment of the present invention. FIG. 1 is a schematic view of an earthquake alert system 1 according to the present invention. The earthquake alert system 1 consists of an earthquake alert server 11 and a plurality of user equipments 13. The earthquake alert server 11 is a remote server which may be erected in a machine room of a telecommunication provider or any enterprise or personal environment. The user equipment 13 may be a smart phone, a tablet computer or any device having a power source module 13*a*, a transceiver 13*b*, a motion sensor 13*c*, a positioning module 13*d* and a processor 13*e*, as shown in FIG. 4.

The user equipment 13 may connect to the earthquake alert system 1 via a network 15. An application program associated with a server 2 may be built in or installed in the user equipment 13, and the user equipment 13 connects to the earthquake alert system 1 by executing the application program. The network 15 may be a mobile communication network, an Internet, a local area network or the like, or a combination of the aforesaid networks.

Figure 2A:
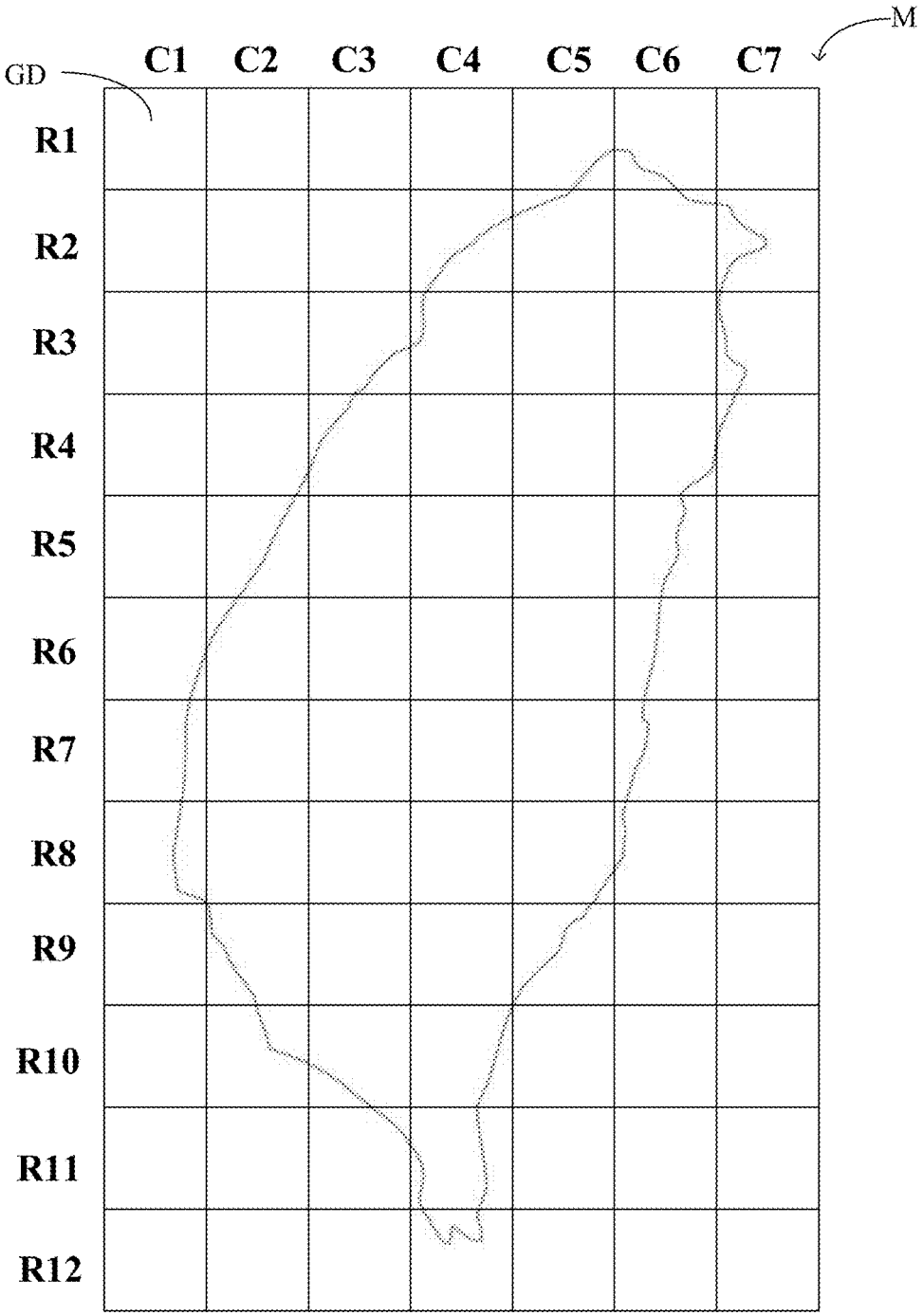
FIG. 2A depicts a map being divided into a plurality of geographic grids.

The earthquake alert server 11 stores a map M and divides the map M into a plurality of geographic grids GD, as shown in FIG. 2A. The user equipment 13 activates an earthquake detection mode when it meets a specific device state condition to sense an earthquake via a motion sensing device. For example, the specific device state condition may include whether the user equipment 13 is in a charging state, whether the user equipment 13 is connected to a network and whether the user equipment 13 is in a stationary state.

In this case, the user equipment 13 may determine that the user equipment 13 is in a charging state in response to connection of the power source module 13*a* to an external power source; determine that the user equipment 13 is in a connected state in response to connection of the transceiver 13*b* to a network 15 (e.g., connection to a base station); and determine that the user equipment 13 is in a stationary state in response to the sensing signal received from the motion sensor 13*c* being smaller than a first threshold continuously within a preset time interval. The transceiver 13*b* may be a mobile network transceiver (e.g., a 3G, 4G mobile network transceiver), a Wi-Fi transceiver or the like. Moreover, in some embodiments, the user equipment 13 may also be an Internet of Things (IOT) device, so the transceiver 13*b* may also be any wireless transceiver, wired transceiver or a combination thereof. The motion sensor 13*c* may be a gravity sensor, a gyroscope, or any hardware module capable of sensing vibration.

The user equipment 13 activates the earthquake detection mode after it meets the aforesaid specific device state condition (i.e., being in the charging state, the connected state and the stationary state simultaneously) to determine whether the sensing signal subsequently received from the motion sensor 13*c* exceeds a second threshold. Next, the user equipment 13 calculates an earthquake intensity, records a time stamp and generates a longitude and latitude value via the positioning module according to the sensing signal if the sensing signal subsequently received from the motion sensor 13*c* exceeds the second threshold. Thereafter, the user equipment 13 immediately generates an earthquake reporting message 102 and transmits the earthquake reporting message 102 to the earthquake alert server 11. The earthquake reporting message 102 generally comprises the longitude and latitude value, the time stamp and the earthquake intensity therein to inform the earthquake alert server 11 of the time point when the earthquake is sensed, and the location and the intensity of the earthquake.

It shall be appreciated that, the aforesaid first threshold is set by the manufacturer of the user equipment 13 when it leaves the factory or is set by the user via a specific program, and the aforesaid second threshold may be set by the user via a specific program or corrected via an application program associated with the server 2 to fit the actual situation of sensing an earthquake. As can be appreciated by those of ordinary skill in the art based on the above descriptions, the setting of the first threshold is to avoid some external slight vibrations (e.g., geomagnetic drifts, operations of surrounding machines or the like) and the setting of the second threshold is to determine whether the vibration reaches the level of an earthquake, and how to adjust the setting of the first threshold and the second threshold shall also be appreciated by those of ordinary skill in the art, and thus this will not be further described herein.

In an actual environment, these user equipments 13 are distributed in different regions, and the user equipments 13 may correspond to different geographic grids GD by dividing the map M into a plurality of geographic grids GD. As shown in FIG. 1, a part of user equipments 13 correspond to a geographic grid R6C2, a part of user equipments 13 correspond to a geographic grid R8C3, and so on. It shall be appreciated that, to simplify the description, FIG. 1 only depicts geographic grids R6C2, R8C3, R7C4, R3C6 and the corresponding user equipments 13 as a representative while other geographic grids are omitted. Moreover, only three user equipments 13 are depicted in each of the geographic grids R6C2, R8C3, R7C4 and R3C6 as a representative. However, the number of the depicted user equipments 13 is not intended to describe the actual situation, and each of the geographic grids may comprise more than three or less than three user equipments 13 in the practical situation, as shall be appreciated by those of ordinary skill in the art.

As described previously, each of the user equipments 13 transmits the earthquake reporting message 102 comprising the longitude and latitude value, the time stamp and the earthquake intensity to the earthquake alert server 11 after an earthquake is sensed by the user equipment 13. Accordingly, it shall be contemplated that, the earthquake alert server 11 will receive the earthquake reporting message 102 from each of the plurality of user equipments. Thereafter, the earthquake alert server 11 may have each of the earthquake reporting messages 102 correspond to one of the geographic grids GD according to the longitude and latitude value of the earthquake reporting message 102.

Figure 2B:
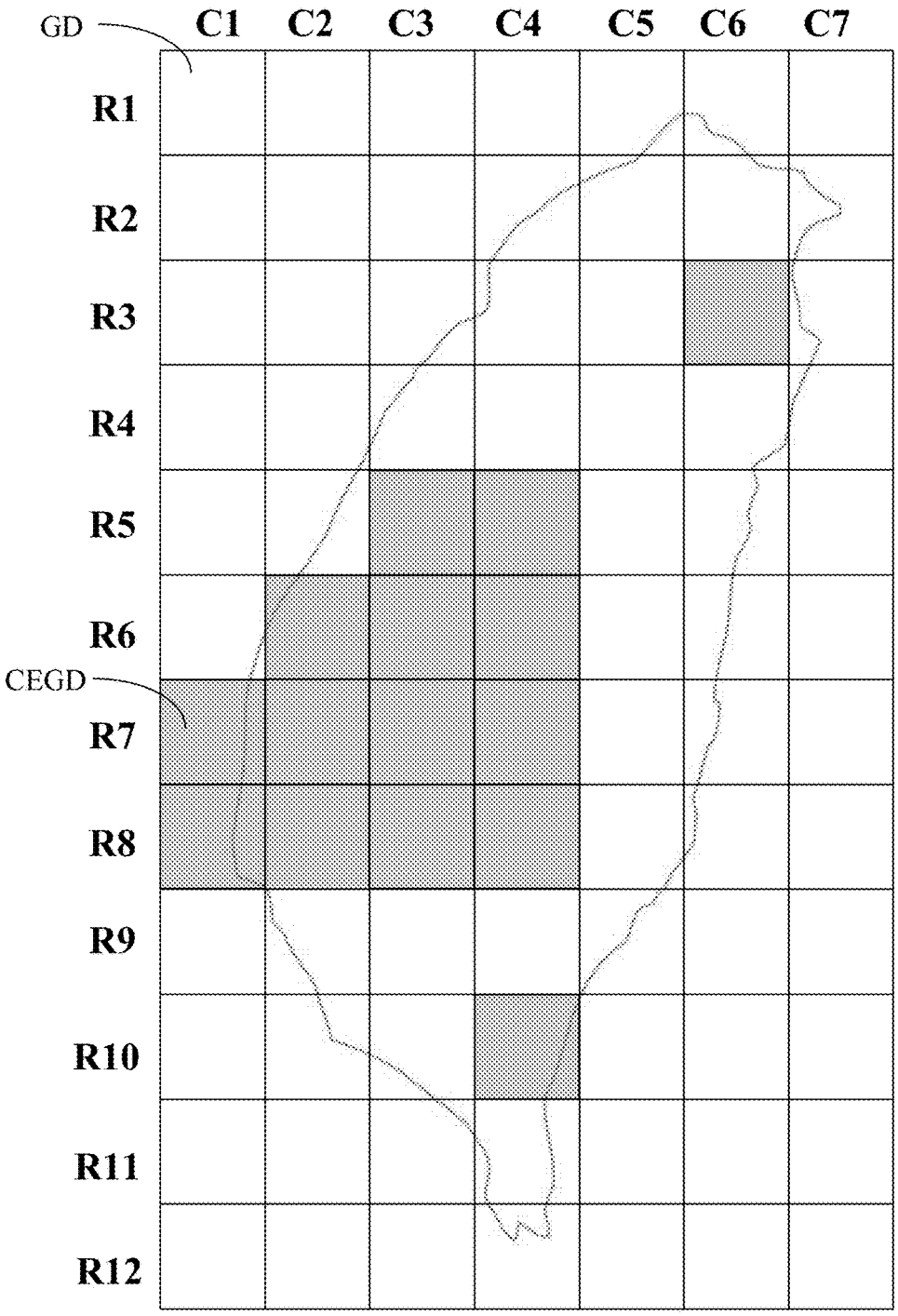
FIG. 2B depicts a plurality of candidate earthquake geographic grids.

The vibration sensed by the user equipment 13 may be caused by the shaking of the user itself rather than a real earthquake. Therefore, in order to filter out the earthquake reporting messages 102 that are wrongly reported, the earthquake alert server 11 determines, for each of the geographic grids GD, the number of earthquake reporting messages of the geographic grid GD within a time interval according to the time stamp of each of the earthquake reporting messages corresponding to the geographic grid GD, and only labels ones of the geographic grids GD of which the number of earthquake reporting messages within the time interval is greater than a threshold as candidate earthquake geographic grids CEGD, as shown in FIG. 2B.

Further speaking, if the vibration sensed by a user equipment 13 is the shaking of the user itself, then only few number of earthquake reporting messages 102 (e.g., only three or four earthquake reporting messages 102) corresponding to the geographic grid GD where the user equipment 13 is located should be received by the earthquake alert server 11 within a short period of time (e.g., within a time interval of 3 seconds). In other words, if an earthquake really happens, then the earthquake should be sensed by all of the user equipments 13 in the region where the earthquake happens and each of the user equipments 13 transmits an earthquake reporting message 102 to the earthquake alert server 11, so the number of the earthquake reporting messages of the geographic grid GD corresponding to the region where the earthquake happens should be greater than a preset threshold (e.g., 30).

It shall be appreciated that, the aforesaid time interval and threshold will vary depending on the size of the geographic grids GD being divided. In other words, when the map M is divided into a smaller number of earthquake geographic grids each having a larger size, the geographic area comprised in each of the earthquake grids is certainly broader and the number of the user equipments 13 within each of the earthquake grids is certainly larger, so the time interval and the threshold should be set to be larger (as compared to the case where the map M is divided into a larger number of earthquake geographic grids each having a smaller size).

For example, if the number of the earthquake reporting messages 102 corresponding to each of the geographic grids R6C2, R7C2, R7C3 and R3C6 within the time interval is greater than the threshold (e.g., 30), then the earthquake alert server 11 labels the geographic grids R6C2, R7C2, R7C3 and R3C6 as candidate earthquake grids CEGD. On the other hand, if the number of the earthquake reporting messages 102 corresponding to the geographic grid R3C5 (e.g., 5) within the time interval does not reach the threshold, then the earthquake alert server 11 will not label the geographic grids R3C5 as a candidate earthquake grid.

After determining the candidate earthquake grids CEGD, the earthquake alert server 11 further filters out the candidate earthquake grids CEGD that are wrongly reported. In detail, although the number of the earthquake reporting messages 102 corresponding to a geographic grid (e.g., the geographic grid R3C6) within the time interval is greater than the threshold, the user equipments in this geographic grid may transmit the earthquake reporting message 102 due to other shaking rather than an earthquake. For example, the passing by of a giant truck will cause a plurality of surrounding user equipments 13 to transmit the earthquake reporting messages 102 simultaneously due to the vibration caused by the giant truck.

Figure 2C:
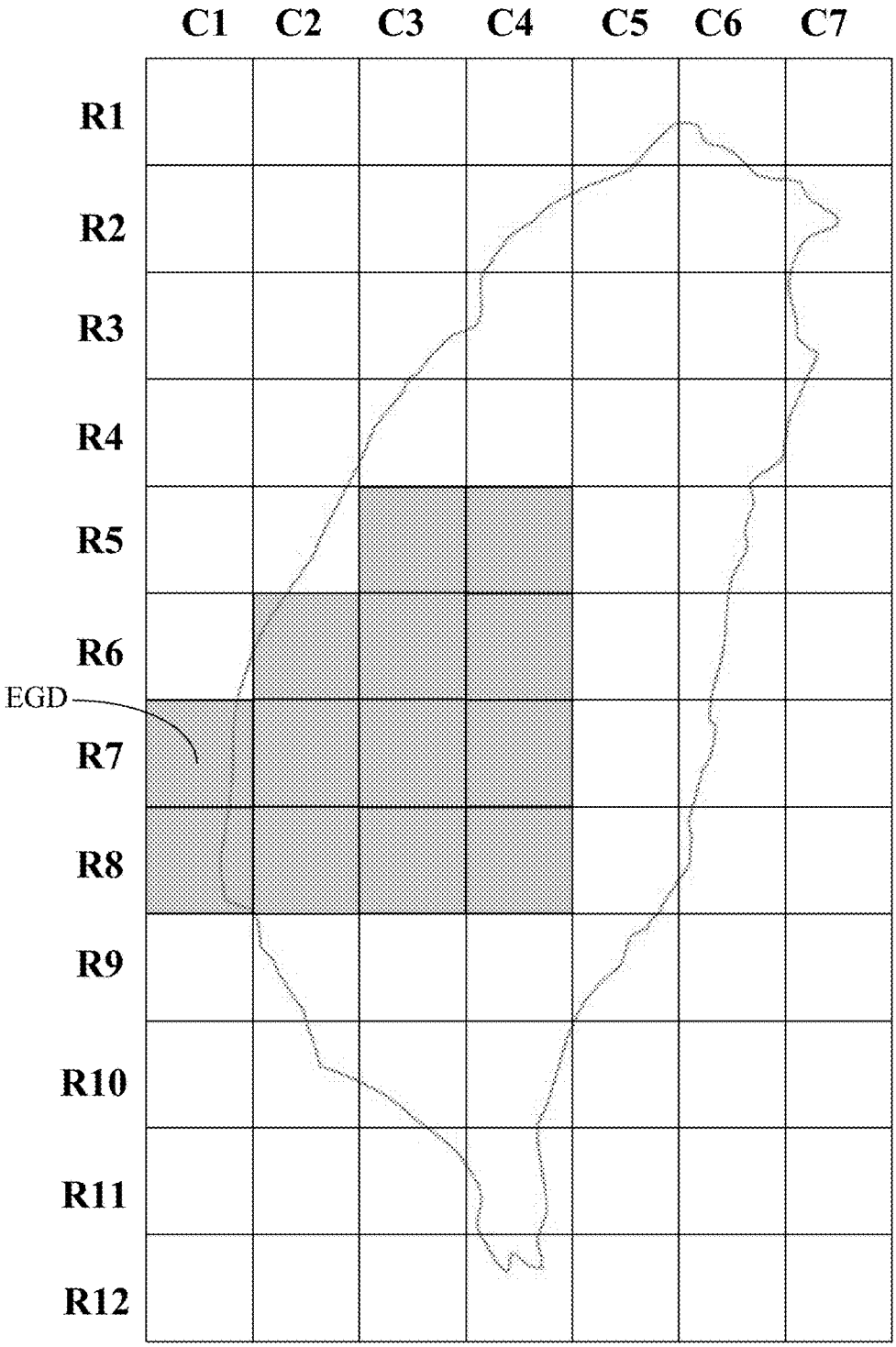
FIG. 2C depicts a plurality of earthquake geographic grids.

Accordingly, the earthquake alert server 11 labels each of the candidate earthquake geographic grids CEGD, which are adjacent, as an earthquake geographic grid EGD according to the adjacency between the candidate earthquake geographic grids CEGD. As shown in FIG. 2B and FIG. 2C, because each of the geographic grids R3C6 and R10C4 has no adjacent geographic grid that is labeled as the candidate earthquake geographic grid CEGD, the earthquake alert server 11 determines that the geographic grids R3C6 and R10C4 are the geographic grids being wrongly reported and only further labels the geographic grids R7C1, R8C1, R6C2, R7C2, R8C2, R5C3, R6C3, R7C3, R8C3, R5C4, R6C4, R7C4 and R8C4 that are labeled as the candidate earthquake geographic grids CEGD as the earthquake geographic grids EGD. In other words, the passing by of the giant truck certainly will not cause vibration in a large area, so the earthquake alert server 11 of the present invention may further filter out the candidate earthquake grids CEGD that are wrongly reported according to the adjacency between the candidate earthquake geographic grids CEGD.

Through the aforesaid filtering mechanism, the earthquake alert server 11 can determine the geographic grids GD corresponding to the region where the earthquake is sensed currently (i.e., earthquake grids EGD). Next, based on these earthquake grids EGD, the earthquake alert server 11 may start to analyze an epicenter of the earthquake, and transmit an earthquake alert message 104 after determining the epicenter. First, the earthquake alert server 11 determines, for each of the earthquake geographic grids EGD, an earthquake reporting time of the earthquake geographic grid EGD according to the time stamp of each of the earthquake reporting messages 102 corresponding to the earthquake geographic grid EGD.

For example, the earthquake alert server 11 may obtain the earthquake reporting time of the earthquake geographic grid EGD by averaging the time stamps of a plurality of earthquake reporting messages 102 corresponding to the earthquake geographic grid EGD. As another example, the earthquake alert server 11 may also select the earliest one of the time stamps of the plurality of earthquake reporting messages 102 corresponding to the earthquake geographic grid EGD as the earthquake reporting time of the earthquake geographic grid EGD.

Next, the earthquake alert server 11 chooses any two of the earthquake geographic grids EGD to obtain a plurality of combinations that are non-repetitive. For example, there are 13 earthquake geographic grids EGD in FIG. 2C, so $C_2^{13}=78$ combinations can be obtained. In other words, if there are n earthquake geographic grids EGD, then $C_2^n$ combinations can be obtained. Thereafter, for each of the combinations, the earthquake geographic grids EGD are divided into two groups GP1 and GP2 according to a middle point CP of two earthquake geographic grids CGD1 and CGD2 of the combination in the map M, and a far value of the earthquake geographic grids EGD in the group, including one of the two earthquake geographic grids of which the earthquake reporting time is later, is increased by one unit (e.g., increased by one).

Figure 2D:
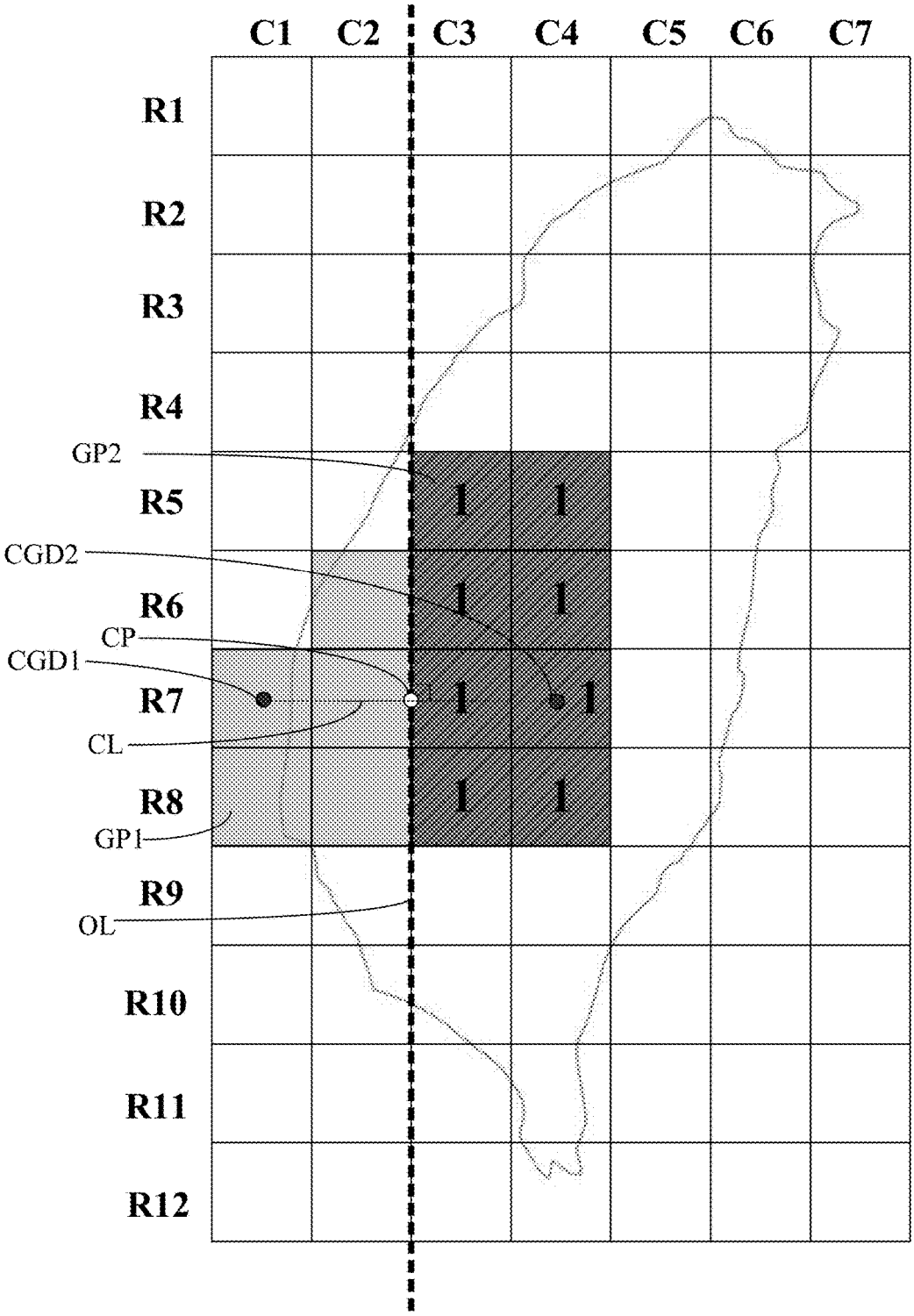
FIG. 2D depicts a combination of any two of the earthquake geographic grids, dividing the earthquake geographic grids into two groups according to a middle point of the two earthquake geographic grids of the combination, and increasing a far value of the earthquake geographic grids in the group, including one of the two earthquake geographic grids of which the earthquake reporting time is later, by one unit.

For example, referring to FIG. 2D, the earthquake alert server 11 first chooses the earthquake geographic grids R7C1 and R7C4 as a combination, so the earthquake geographic grid R7C1 is the earthquake geographic grid CGD1 and the earthquake geographic grid R7C4 is the earthquake geographic grid CGD2 in the selected combination. Thereafter, the earthquake alert server 11 divides the map M into two equal parts based on a perpendicular bisector OL passing through the middle point CP to classify the earthquake geographic grids EGD falling into the two equal parts respectively as the two groups GP1 and GP2.

As shown in FIG. 2D, the perpendicular bisector OL is perpendicular to a connection line CL between the earthquake geographic grids CGD1 and CGD2. The complete earthquake geographic grids R7C1, R8C1, R6C2, R7C2 and R8C3 at the left side of the perpendicular bisector OL belong to the group GP1, while the complete earthquake geographic grids R5C3, R6C3, R7C3, R8C3, R5C4, R6C4, R7C4 and R8C4 at the right side of the perpendicular bisector OL belong to the group GP2. Here it is assumed that the earthquake reporting time of the earthquake geographic grid CGD1 is earlier than that of the earthquake geographic grid CGD2, so the earthquake alert server 11 increases a far value of the earthquake geographic grids EGD in the group GP2, including the earthquake geographic grid CGD2 of which the earthquake reporting time is later, by one as shown in FIG. 2D.

Figure 2E:
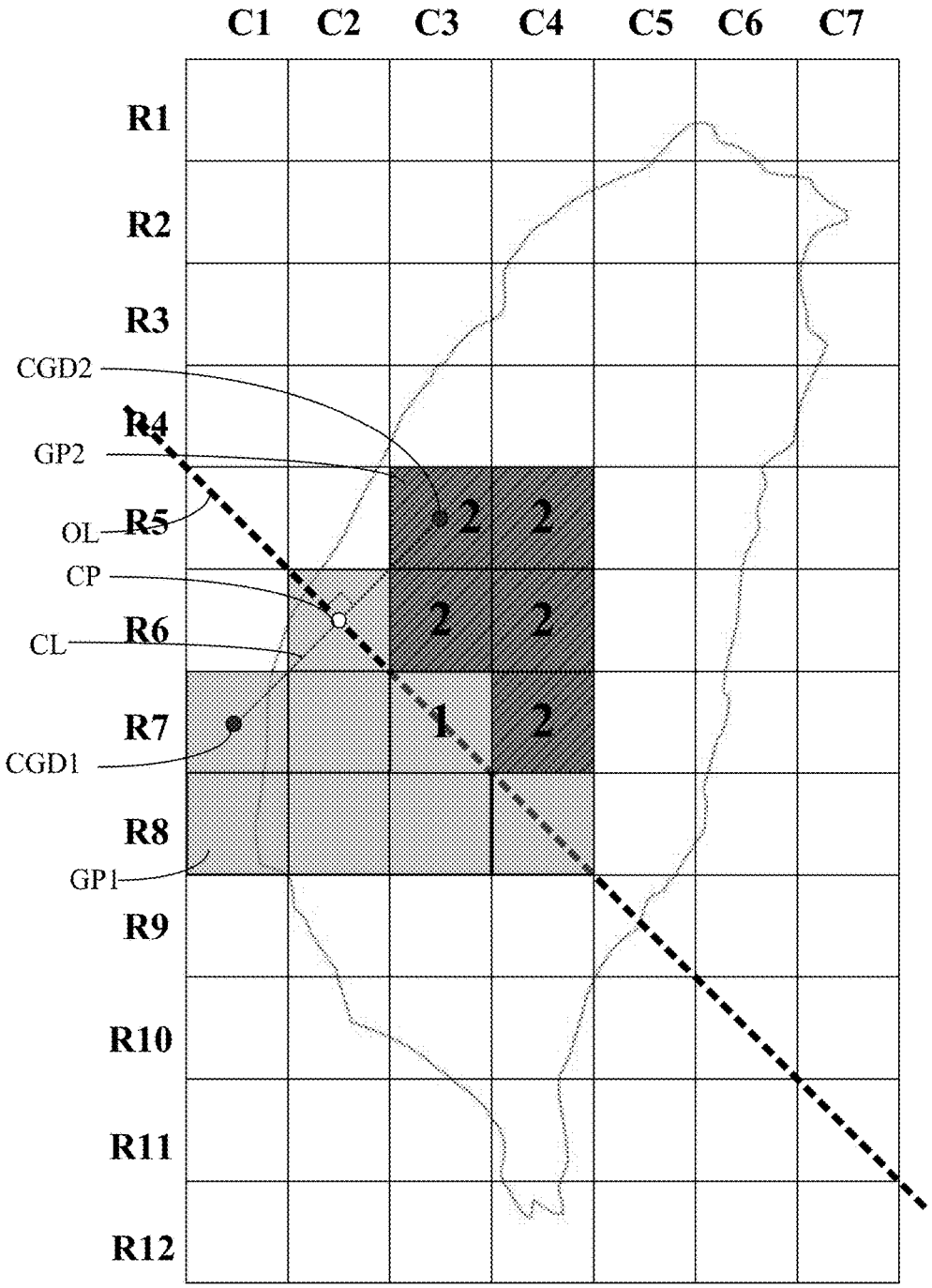
FIG. 2E depicts another combination of any two of the earthquake geographic grids, dividing the earthquake geographic grids into two groups according to a middle point of the two earthquake geographic grids of the combination, and increasing a far value of the earthquake geographic grids in the group, including one of the two earthquake geographic grids of which the earthquake reporting time is later, by one unit.

Similarly, referring to FIG. 2E, the earthquake alert server 11 next chooses the earthquake geographic grids R7C1 and R5C3 as a combination, so the earthquake geographic grid R7C1 is the earthquake geographic grid CGD1 and the earthquake geographic grid R5C3 is the earthquake geographic grid CGD2 in the selected combination. Thereafter, the earthquake alert server 11 divides the map M into two equal parts based on a perpendicular bisector OL passing through the middle point CP to classify the earthquake geographic grids EGD falling into the two equal parts respectively as the two groups GP1 and GP2.

As described previously, the perpendicular bisector OL is perpendicular to a connection line CL between the earthquake geographic grids CGD1 and CGD2. The complete earthquake geographic grids R7C1, R8C1, R7C2, R8C2 and R8C3 at the left side of the perpendicular bisector OL belong to the group GP1, while the complete earthquake geographic grids R5C3, R6C3, R5C4, R6C4, and R7C4 at the right side of the perpendicular bisector OL belong to the group GP2. Here it is assumed that the earthquake reporting time of the earthquake geographic grid CGD1 is also earlier than that of the earthquake geographic grid CGD2, so the earthquake alert server 11 increases a far value of the earthquake geographic grids EGD in the group GP2, including the earthquake geographic grid CGD2 of which the earthquake reporting time is later, by one as shown in FIG. 2E.

Figure 2F:
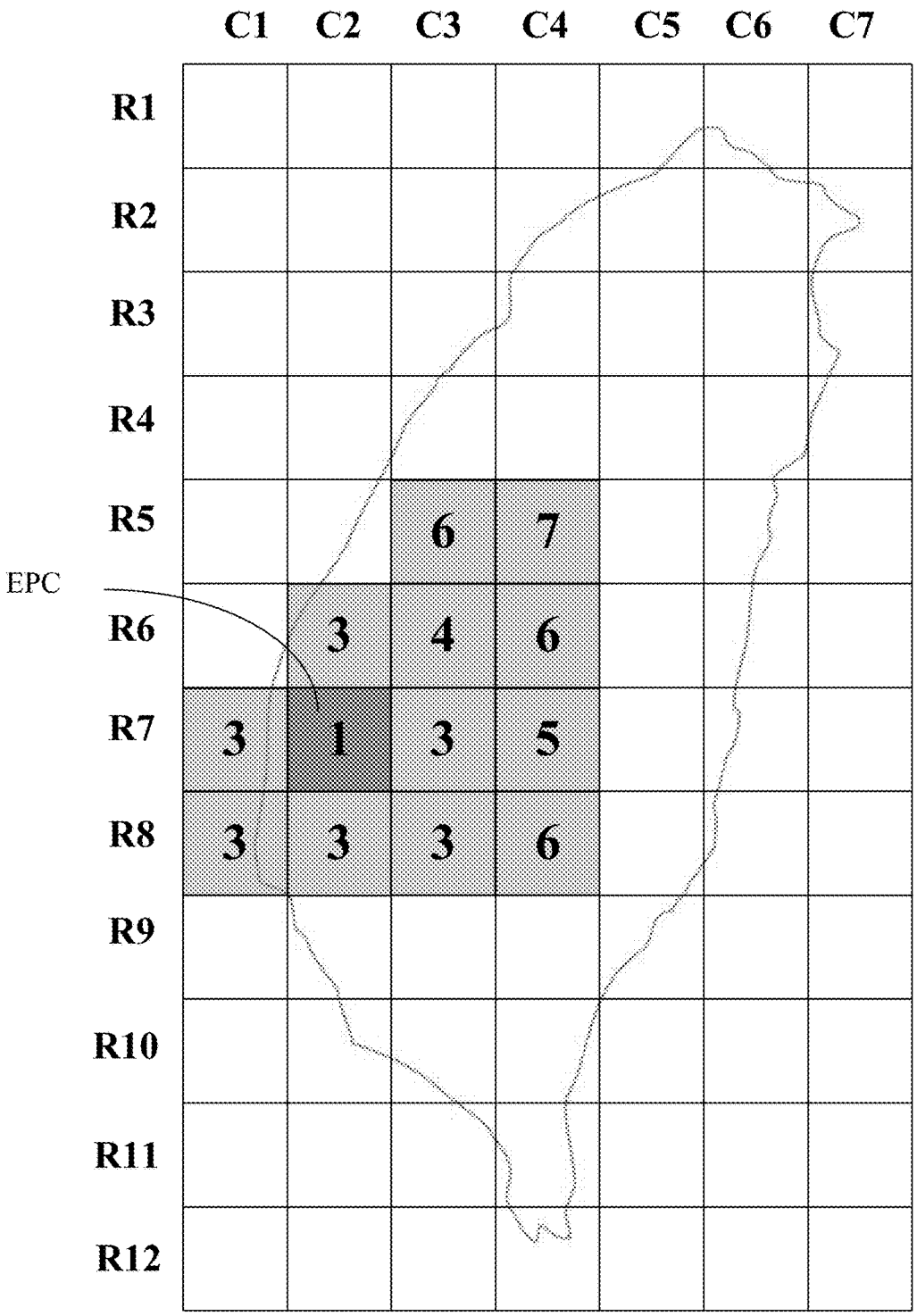
FIG. 2F depicts the far values of the earthquake grids after performing group dividing on multiple combinations and totaling the far values, with the earthquake grid with the smallest far value being labeled as an epicenter geographic grid.

After applying the aforesaid similar operations to multiple other combinations, the earthquake alert server 11 may generally obtain a convergent result, as shown in FIG. 2F. FIG. 2F depicts the far values of the earthquake geographic grids EGD obtained by performing the earthquake directional analysis on seven selected combinations, wherein the earthquake geographic grid R7C2 is obviously the smallest as compared to other earthquake geographic grids EGD. Accordingly, the earthquake geographic grid with the smallest far value (i.e., the earthquake geographic grid R7C2) is labeled as an epicenter geographic grid EPC.

It shall be appreciated that, FIG. 2F is only illustrated as a simple exemplary example, and as shall be appreciated by those of ordinary skill in the art, the number of combinations required to determine the epicenter each time the earthquake analysis is performed to achieve the convergent result may vary depending on the position and the terrain of the region where the earthquake occurs. Therefore, the present invention does not limit the number of combinations on which the direction analysis is performed, and any number of combinations is within the scope claimed in the present invention.

Moreover, for simplification of the description, the map M is only divided into 84 geographic grids GD in FIG. 2A to FIG. 2F by dividing the horizontal axis into 7 equal parts (i.e., the horizontal axis is labeled from C1 to C7) and the vertical axis into 12 equal parts (i.e., the vertical axis is labeled from R1 to R12). However, how to perform the directional analysis to determine the epicenter in the case where the map M is divided into other number of geographic grids shall be appreciated by those of ordinary skill in the art based on the aforesaid description, and thus will not be further described herein. Additionally, the middle point CP between the earthquake geographic grid CGD1 and the earthquake geographic grid CGD2 is determined in a two-dimensional plane in this embodiment. However, as shall be appreciated by those of ordinary skill in the art, the middle point CP between the earthquake geographic grid CGD1 and the earthquake geographic grid CGD2 may also be determined in a three-dimensional plane in other embodiments.

After determining the epicenter geographic grid EPC, the earthquake alert server 11 determines an epicenter position, an epicenter occurrence time and an epicenter intensity according to the longitude and latitude value, the time stamp and the epicenter intensity of each of the earthquake reporting messages 102 corresponding to the epicenter geographic grid EPC. For example, the earthquake alert server 11 may obtain the epicenter position, the epicenter occurrence time and the epicenter intensity by averaging the longitude and latitude values, the time stamps and the epicenter intensities of the earthquake reporting messages 102, respectively. Thereafter, the earthquake alert server 11 may generate an earthquake alert message 104 carrying the epicenter position, the epicenter occurrence time and the epicenter intensity, and transmit the earthquake alert message 104 to a plurality of remote devices via the network 15.

The aforesaid remote devices further comprises user equipments 13 that have not yet sensed the earthquake to transmit the earthquake reporting message 102 in addition to the user equipments 13 that transmit the earthquake reporting messages 102 previously. In other words, the earthquake alert server 11 transmits the earthquake alert message 104 to all the user equipments 13 in which the application program associated with the server 2 is installed. Moreover, the remote devices may also comprise other third-party devices that assist in issuing the earthquake alert. For example, the earthquake alert server 11 transmits the earthquake alert message 104 to a server of the central weather bureau or service servers of various telecommunication providers so that the third-party institutions or organizations can assist in issuing the earthquake alert to broadcast the earthquake alert as much as possible, thereby obtaining the longest escape time.

Additionally, in other embodiments, after determining the earthquake geographic grid EGD, the earthquake alert server 11 may first generate and transmit an advance earthquake alert message (not shown) to the remote devices to inform the remote devices of an earthquake occurrence event. In other words, after determining the occurrence of the earthquake, the earthquake alert server 11 may first transmit an advance earthquake alert message to the remote devices to further obtain more escape time. Then, after determining the epicenter, the earthquake alert server 11 transmits the earthquake alert message 104 to notify more detailed earthquake information.

Figure 3:
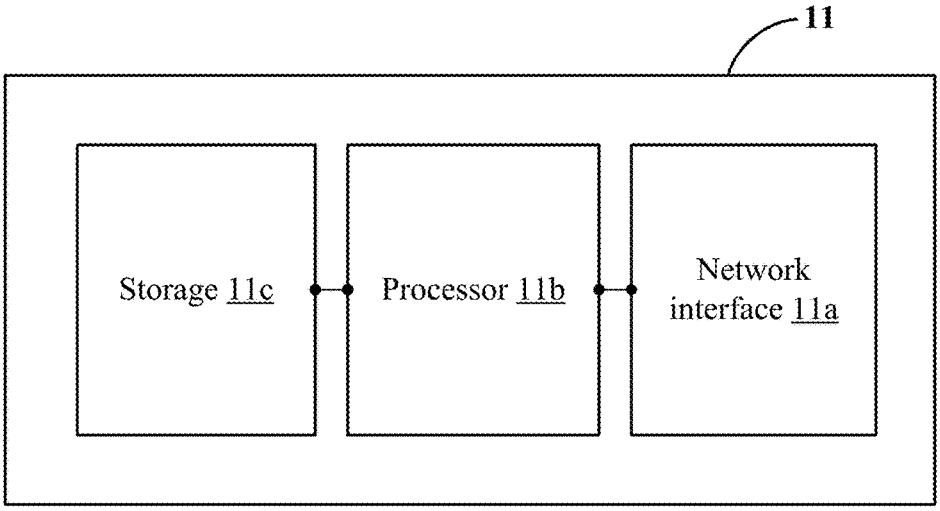
FIG. 3 is a schematic view of an earthquake alert server 11 according to the present invention.

A second embodiment of the present invention is as shown in FIG. 3, which is a schematic view of the earthquake alert server 11 of the present invention. The earthquake alert server 11 comprises a network interface 11*a*, a processor 11*b* and a storage 11*c*. The network interface 11*a* may be a wired network interface, a wireless network interface and/or a combination thereof for connecting to the network 15. The storage 11*c* may be a memory, a hard disk or any other device for storing data. The storage 11*c* may be configured to store the map M.

The processor 11*b* is electrically connected to the network interface 11*a* and the storage 11*c*. The processor 11*b* divides the map M into a plurality of geographic grids GD. The processor 11*b* may receive an earthquake reporting message 102 from each of a plurality of user equipments 13 via the network interface 11*a*. Next, the processor 11*b* maps each of the earthquake reporting messages 102 to one of the geographic grids GD according to the longitude and latitude value of the earthquake reporting message 102, and determines, for each of the geographic grids GD, the number of earthquake reporting messages of the geographic grid GD within a time interval according to the time stamp of each of the earthquake reporting messages 102 corresponding to the geographic grid GD. In this way, the processor 11*b* may label ones of the geographic grids GD of which the number of earthquake reporting messages within the time interval is greater than a threshold as candidate earthquake geographic grids CEGD, as shown in FIG. 2B.

Thereafter, the processor 11*b* labels each of the candidate earthquake geographic grids, which are adjacent, as an earthquake geographic grid EGD after obtaining the plurality of candidate earthquake geographic grids CEGD, as shown in FIG. 2C. Then, the processor 11*b* performs earthquake directional analysis on the earthquake geographic grid EGD. First, the processor 11*b* determines, for each of the earthquake geographic grids EGD, an earthquake reporting time of the earthquake geographic grid EGD according to the time stamp of each of the earthquake reporting messages 102 corresponding to the earthquake geographic grid EGD. Next, any two of the earthquake geographic grids EGD are chosen to obtain a plurality of combinations that are non-repetitive, and for each of the combinations, the earthquake geographic grids EGD are divided into two groups GP1 and GP2 according to a middle point CP of the two earthquake geographic grids EGD of the combination in the map M, and a far value of the earthquake geographic grids in the group, including one of the two earthquake geographic grids of which the earthquake reporting time is later, is increased by one as shown in FIG. 2D and FIG. 2E. For example, for each of the combinations, the processor 13*b* may divides the map M into two equal parts based on a perpendicular bisector OL passing through the middle point CP to classify the earthquake geographic grids falling into the two equal parts respectively as the two groups GP1 and GP2. The perpendicular bisector OL is perpendicular to a connection line CL between the two earthquake geographic grids in the combination.

Thereafter, the processor 11*b* labels the earthquake geographic grid with the smallest far value as an epicenter geographic grid EPC, as shown in FIG. 2F. After determining the epicenter geographic grid EPC, the processor 11*b* determines the epicenter position, the epicenter occurrence time and the epicenter intensity according to the longitude and latitude value, the time stamp and the epicenter intensity of each of the earthquake reporting messages 102 corresponding to the epicenter geographic grid EPC. For example, the processor 11*b* may obtain the epicenter position, the epicenter occurrence time and the epicenter intensity by averaging the longitude and latitude values, the time stamps and the epicenter intensities of the earthquake reporting messages 102 corresponding to the epicenter geographic grid, respectively.

Thereafter, the processor 11*b* generates an earthquake alert message 104 carrying the epicenter position, the epicenter occurrence time and the epicenter intensity, and transmits the earthquake alert message 104 to a plurality of remote devices via the network interface 11*a*. As described previously, the remote devices may comprise a plurality of other user equipments. These other user equipments may be user equipments 13 from each of which the processor 11*b* has not yet received the earthquake reporting message 102 via the network interface 11*a*. Moreover, in other embodiments, after labeling each of the candidate earthquake geographic grids, which are adjacent, as an earthquake geographic grid EGD, the processor 11*b* may further generate and transmit an advance earthquake alert message to the remote devices to inform the remote devices of an earthquake occurrence event.

A third embodiment of the present invention is as shown in FIG. 4, which is a schematic view of a user equipment 13 of the present invention. The user equipment 13 comprises a power source module 13*a*, a transceiver 13*b*, a motion sensor 13*c*, a positioning module 13*d* and a processor 13*e*. The processor 13*e* is electrically connected to the power source module 13*a*, the transceiver 13*b*, the motion sensor 13*c*, and the positioning module 13*d*.

As described previously, the motion sensor 13*c* may be a gravity sensor, a gyroscope, or any hardware module capable of sensing vibration. The motion sensor is configured to sense a motion and generate a sensing signal. Moreover, the positioning module 13*d* may be a global positioning system (GPS) module or a positioning module based on a telecommunication base station and/or a WiFi access point. Moreover, as described previously, the transceiver 13*b* may be a mobile network transceiver (e.g., a 3G, 4G mobile network transceiver), a Wi-Fi transceiver or the like. Additionally, in some embodiments, the user equipment 13 may also be an Internet of Things device, so the transceiver 13*b* may also be any wireless transceiver, wired transceiver or a combination thereof.

The processor 13*c* determines that the user equipment 13 is in a charging state in response to connection of the power source module 13*a* to an external power source, and determines that the user equipment 13 is in a connected state in response to connection of the transceiver 13*b* to a network. Moreover, the processor 13*e* determines that the user equipment 13 is in a stationary state in response to the sensing signal received from the motion sensor 13*c* being smaller than a first threshold continuously within a preset time interval. The processor 13*e* activates an earthquake detection mode when the user equipment 13 is being in the charging state, the connected state and the stationary state simultaneously to determine whether the sensing signal subsequently received from the motion sensor 13*c* exceeds a second threshold.

When the sensing signal subsequently received from the motion sensor 13*c* exceeds the second threshold, the processor 13*e* calculates an earthquake intensity, records a time stamp and generates via the positioning module 13*d* a longitude and latitude value according to the sensing signal. Thereafter, the processor 13*e* generates an earthquake reporting message 104 comprising the longitude and latitude value, the time stamp and the earthquake intensity, and transmits the earthquake reporting message 104 to an earthquake alert server 11 via the transceiver.

Additionally, in other embodiments, the processor 13*e* may further correct an earthquake intensity correspondence curve according to at least one external historical earthquake intensity record (e.g., earthquake observation information announced by an earthquake reporting system in the central weather bureau), and obtains the earthquake intensity corresponding to the sensing signal based on the earthquake intensity correspondence curve. The earthquake intensity correspondence curve has each of different values represented by the sensing signals correspond to an earthquake intensity. In this way, the user equipment 13 of the present invention can learn from the external historical earthquake intensity record to correct the earthquake intensity correspondence curve so that a more accurate earthquake intensity can be obtained based on the earthquake intensity curve when an earthquake is sensed in the future.

Please refer to FIG. 5A and FIG. 5B for a fourth embodiment of the present invention, and FIG. 5A and FIG. 5B are flowchart diagrams of an earthquake alert method according to the present invention. The earthquake alert method of the present invention is adapted for use in an earthquake alert server (e.g., the earthquake alert server 11 of the aforesaid embodiments) of an earthquake alert system. The earthquake alert server comprises a network interface, a storage and a processor. The earthquake alert method is executed by the processor.

Please refer to FIG. 5A. First, in step S501, a map stored in the storage is divided into a plurality of geographic grids. Next, in step S503, an earthquake reporting message is received from each of a plurality of user equipments via the network interface, and each of the earthquake reporting messages comprises a longitude and latitude value, a time stamp and an earthquake intensity. Thereafter, in step S505, each of the earthquake reporting messages corresponds to one of the geographic grids according to the longitude and latitude value of the earthquake reporting message. Then, in step S507, for each of the geographic grids, the number of earthquake reporting messages of the geographic grid within a time interval is determined according to the time stamp of each of the earthquake reporting messages corresponding to the geographic grid.

In step S509, ones of the geographic grids of which the number of earthquake reporting messages within the time interval is greater than a threshold are labeled as candidate earthquake geographic grids. Next, in step S511, each of the candidate earthquake geographic grids, which are adjacent, is labeled as an earthquake geographic grid. Then, in step S513, for each of the earthquake geographic grids, an earthquake reporting time of the earthquake geographic grid is determined according to the time stamp of each of the earthquake reporting messages corresponding to the earthquake geographic grid.

Next, please refer to FIG. 5B. In step S515, any two of the earthquake geographic grids are chosen to obtain a plurality of combinations that are non-repetitive. Next, in step S517, for each of the combinations, the earthquake geographic grids are divided into two groups according to a middle point of the two earthquake geographic grids of the combination in the map, and a far value of the earthquake geographic grids in the group, including one of the two earthquake geographic grids of which the earthquake reporting time is later, is increased by one unit. Thereafter, in step S519, the earthquake geographic grid with the smallest far value is labeled as an epicenter geographic grid. Then, in step S521, an epicenter position, an epicenter occurrence time and an epicenter intensity are determined according to the longitude and latitude value, the time stamp and the epicenter intensity of each of the earthquake reporting messages corresponding to the epicenter geographic grid.

In step S523, an earthquake alert message carrying the epicenter position, the epicenter occurrence time and the epicenter intensity is generated. Finally, in step S525, the processor transmits the earthquake alert message to a plurality of remote devices via the network interface. As described previously, the remote devices may further include other user equipments that have not reported the earthquake message in addition to the aforesaid user equipments. It shall be appreciated that, each time the earthquake alert is issued after the earthquake analysis, the earthquake alert server may reset each of the geographic grids GD to the original state, i.e., no candidate earthquake geographic grid, earthquake geographic grid, or epicenter geographic grid is labeled, and the far value of each of the geographic grids GD is set to be zero. Thereafter, the steps S503 to S525 are repeated to sense the occurrence of a next earthquake and issue an alert.

Furthermore, it is unnecessary for the step S501 to be executed each time the earthquake sensing and analyzing is performed. In other words, the map does not need to be re-divided after it has been divided, unless a system manager wants to adjust parameters for the dividing.

Additionally, the step S511 will not be executed if there is no candidate earthquake geographic grid in the step S509. Similarly, the step S513 will not be executed if there is no earthquake geographic grid in the step S511.

In addition to the aforesaid steps, the earthquake alert method of the present invention can also execute all the operations and functions set forth in all the aforesaid embodiments. How this embodiment executes these operations and functions will be readily appreciated by those of ordinary skill in the art based on the explanation of all the aforesaid embodiments, and thus will not be further described herein.

Additionally, the earthquake alert method described previously of the present invention may be implemented by a non-transitory computer readable medium. The non-transitory computer readable medium stores a computer program comprising a plurality of codes. When the computer program is loaded and installed into an electronic computing device (e.g., the earthquake alert server 11), the codes comprised in the computer program are executed by the processor of the electronic device to execute the earthquake alert method of the present invention. The computer program product may be for example a read only memory (ROM), a flash memory, a floppy disk, a hard disk, a compact disk (CD), a mobile disk, a magnetic tape, a database accessible to networks, or any other storage media with the same function and well known to those of ordinary skill in the art.

According to the above descriptions, the earthquake alert system of the present invention detects an earthquake and provides the geographic position where the earthquake occurs to the earthquake alert server via the motion sensor and the positioning module built in the smart phone, and the earthquake alert server chooses the earthquake reporting messages of a higher reliability through a filtering mechanism to analyze the direction of the earthquake and determine the position of the epicenter. Accordingly, as compared to sensing the earthquake wave (of which the propagation speed is about 10 kilometers per second) via the earthquake detecting station in the prior art, the present invention enables the smart phones in the region where the earthquake occurs to report the occurrence of the earthquake immediately via telecommunication transmission at a high speed (which is about 300,000 kilometers per second) so that a higher density of earthquake information can be obtained to determine the epicenter accurately and rapidly, thereby providing a timely earthquake detection and alert service to obtain more escape time.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An earthquake alert server, comprising:

a network interface, connecting to a network;

a storage, being configured to store a map; and a processor electrically connected to the storage and the network interface, being configured to execute the following operations:

dividing the map into a plurality of geographic grids;

receiving an earthquake reporting message from each of a plurality of user equipments via the network interface, each of the earthquake reporting messages comprising a longitude and latitude value, a time stamp and an earthquake intensity;

mapping each of the earthquake reporting messages to one of the geographic grids according to the longitude and latitude value of the earthquake reporting message;

determining, for each of the geographic grids, a number of earthquake reporting messages of the geographic grid within a time interval according to the time stamp of each of the earthquake reporting messages corresponding to the geographic grid;

labeling the geographic grid, of which the number of earthquake reporting messages within the time interval is greater than a threshold, as a candidate earthquake geographic grid;

labeling each of the candidate earthquake geographic grids, which are adjacent, as an earthquake geographic grid;

determining, for each of the earthquake geographic grids, an earthquake reporting time of the earthquake geographic grid according to the time stamp of each of the earthquake reporting messages corresponding to the earthquake geographic grid;

choosing any two of the earthquake geographic grids to obtain a plurality of combinations that are non-repetitive;

dividing, for each of the combinations, the earthquake geographic grids into two groups according to a middle point of the two earthquake geographic grids of the combination in the map, and increasing a far value of the earthquake geographic grids in the group, including one of the two earthquake geographic grids of which the earthquake reporting time is later, by one unit;

labeling the earthquake geographic grid with the smallest far value as an epicenter grid;

determining an epicenter position, an epicenter occurrence time and an epicenter intensity according to the longitude and latitude value, the time stamp and the epicenter intensity of each of the earthquake reporting messages corresponding to the epicenter geographic grid;

generating an earthquake alert message carrying the epicenter position, the epicenter occurrence time and the epicenter intensity; and transmitting the earthquake alert message to a plurality of remote devices via the network interface, wherein the remote devices include the user equipments.

2. The earthquake alert server of claim 1, wherein for each of the combinations, the processor divides the map into two equal parts based on a perpendicular bisector passing through the middle point to classify the earthquake geographic grids falling into the two equal parts respectively as the two groups, and the perpendicular bisector is perpendicular to a connection line between the two earthquake geographic grids in the combination.

3. The earthquake alert server of claim 1, wherein the processor obtains the epicenter position, the epicenter occurrence time and the epicenter intensity by averaging the longitude and latitude values, the time stamps and the earthquake intensities of the earthquake reporting messages corresponding to the epicenter geographic grid, respectively.

4. The earthquake alert server of claim 1, wherein the remote devices further include a plurality of other user equipments, and the processor has not received another earthquake reporting message from each of the other user equipments via the network interface.

5. The earthquake alert server of claim 1, wherein, after labeling each of adjacent ones of the candidate earthquake geographic grids as an earthquake geographic grid, the processor further generates and transmits an advance earthquake alert message to the remote devices to inform the remote devices of an earthquake occurrence event.

6. An earthquake alert method for an earthquake alert server, the earthquake alert server comprising a network interface, a storage and a processor, the network interface connecting to a network, the storage storing a map therein, and the earthquake alert method being executed by the processor and comprising:

(a) dividing the map into a plurality of geographic grids;

(b) receiving an earthquake reporting message from each of a plurality of user equipments via the network interface, each of the earthquake reporting messages comprising a longitude and latitude value, a time stamp and an earthquake intensity;

(c) mapping each of the earthquake reporting messages to one of the geographic grids according to the longitude and latitude value of the earthquake reporting message;

(d) determining, for each of the geographic grids, a number of earthquake reporting messages of the geographic grid within a time interval according to the time stamp of each of the earthquake reporting messages corresponding to the geographic grid;

(e) labeling the geographic grid, of which the number of earthquake reporting messages within the time interval is greater than a threshold, as a candidate earthquake geographic grid;

(f) labeling each of the candidate earthquake geographic grids, which are adjacent, as an earthquake geographic grid;

(g) determining, for each of the earthquake geographic grids, an earthquake reporting time of the earthquake geographic grid according to the time stamp of each of the earthquake reporting messages corresponding to the earthquake geographic grid;

(h) choosing any two of the earthquake geographic grids to obtain a plurality of combinations that are non-repetitive;

(i) dividing, for each of the combinations, the earthquake geographic grids into two groups according to a middle point of the two earthquake geographic grids of the combination in the map, and increasing a far value of the earthquake geographic grids in the group, including one of the two earthquake geographic grids of which the earthquake reporting time is later, by one unit;

(j) labeling the earthquake geographic grid with the smallest far value as an epicenter grid;

(k) determining an epicenter position, an epicenter occurrence time and an epicenter intensity according to the longitude and latitude value, the time stamp and the epicenter intensity of each of the earthquake reporting messages corresponding to the epicenter geographic grid;

(l) generating an earthquake alert message carrying the epicenter position, the epicenter occurrence time and the epicenter intensity; and (m) transmitting the earthquake alert message to a plurality of remote devices via the network interface, wherein the remote devices include the user equipments.

7. The earthquake alert method of claim 6, wherein the step (i) further comprises the following step:

dividing, for each of the combinations, the map into two equal parts based on a perpendicular bisector passing through the middle point to classify the earthquake geographic grids falling into the two equal parts respectively as the two groups, and the perpendicular bisector being perpendicular to a connection line between the two earthquake geographic grids in the combination.

8. The earthquake alert method of claim 6, wherein the step (k) further comprises:

obtaining the epicenter position, the epicenter occurrence time and the epicenter intensity by averaging the longitude and latitude values, the time stamps and the earthquake intensities of the earthquake reporting messages corresponding to the epicenter geographic grid, respectively.

9. The earthquake alert method of claim 6, wherein the remote devices further include a plurality of other user equipments, and the processor has not received another earthquake reporting message from each of the other user equipments via the network interface.

10. The earthquake alert method of claim 6, further comprising the following after the step (f):

generating and transmitting an advance earthquake alert message to the remote devices to inform the remote devices of an earthquake occurrence event.

11. A user equipment, comprising:

a power source module;

a transceiver;

a motion sensor, being configured to sense a motion and generate a sensing signal;

a positioning module; and a processor electrically connected to the power source module, the transceiver, the motion sensor and the positioning module, being configured to execute the following operations:

determining that the user equipment is in a charging state in response to connection of the power source module to an external power source;

determining that the user equipment is in a connected state in response to connection of the transceiver to a network;

determining that the user equipment is in a stationary state in response to the sensing signal received from the motion sensor being smaller than a first threshold continuously within a preset time interval;

activating an earthquake detection mode if the user equipment is being in the charging state, the connection state and the stationary state simultaneously to determine whether the sensing signal subsequently received from the motion sensor exceeds a second threshold;

if the sensing signal subsequently received from the motion sensor exceeds the second threshold, then calculating an earthquake intensity, recording a time stamp and generating a longitude and latitude value via the positioning module according to the sensing signal;

generating an earthquake reporting message comprising the longitude and latitude value, the time stamp and the earthquake intensity; and transmitting the earthquake reporting message to an earthquake alert server via the transceiver.

12. The user equipment of claim 11, wherein the processor further corrects an earthquake intensity correspondence curve according to at least one external historical earthquake intensity record, and obtains the earthquake intensity corresponding to the sensing signal based on the earthquake intensity correspondence curve.

* * * * *